US006282752B1

(12) United States Patent
Klüting et al.

(10) Patent No.: US 6,282,752 B1
(45) Date of Patent: Sep. 4, 2001

(54) DOOR HINGE ASSEMBLY WITH INTEGRATED DOOR LOCK FOR A MOTOR VEHICLE DOOR

(75) Inventors: Bernd-Alfred Klüting, Radevormwald; Andreas Bonné , Grünenbach; Friedrich G. Klingelhöfer, Remscheid, all of (DE)

(73) Assignee: Ed. Scharwächter GmbH & Co. KG, Remscheid (DE)

( * ) Notice: Subject to any disclaimer, the term of this patent is extended or adjusted under 35 U.S.C. 154(b) by 0 days.

(21) Appl. No.: 08/856,163

(22) Filed: May 14, 1997

(30) Foreign Application Priority Data

May 14, 1996 (DE) ..... 196 19 473

(51) Int. Cl.[7] ..... E05D 11/10

(52) U.S. Cl. ..... 16/334; 16/330; 16/331; 16/322

(58) Field of Search ..... 16/334, 330, 328, 16/329, 331, 352, 353, 312–314, 299, 300, 321, 322, 374, 340

(56) References Cited

U.S. PATENT DOCUMENTS 1,078,002 * 11/1913 Schrey ..... 16/334
1,159,529 * 11/1915 Parizek ..... 16/334
2,635,281 * 4/1953 Feldberg ..... 16/334
3,028,619 * 4/1962 Schlage et al. ..... 16/50
4,532,675 * 8/1985 Salazar ..... 16/374
4,829,633 * 5/1989 Kassner ..... 16/334
5,173,993 * 12/1992 Baker ..... 16/329
5,269,047 * 12/1993 Lu ..... 16/340

FOREIGN PATENT DOCUMENTS 8401062.2-U * 3/1987 (DE) .
8627459.7-U * 11/1987 (DE) .
4212181-A * 10/1993 (DE) .
29700043-U * 3/1997 (DE) .
1203451 * 1/1960 (FR) ..... 16/334

* cited by examiner

*Primary Examiner*—Chuck Y. Mah
(74) *Attorney, Agent, or Firm*—Sidley Austin Brown & Wood, LLP

(57) ABSTRACT

A door hinge assembly for a motor vehicle door and including a door hinge having two hinge halves attachable, respectively, to the motor vehicle door and a respective motor vehicle door pillar, and a hinge pin for connecting the two hinge halves and supported in one of the hinge halves with a running fit and removably secured in another of the two hinge halves without a possibility of rotation with respect to the another half; and a door lock formed integrally with the door hinge and including a locking element having at least one detent point and at least one brake and locking member cooperating with the locking element and located radially outwardly of the hinge pin.

13 Claims, 3 Drawing Sheets

DOOR HINGE ASSEMBLY WITH INTEGRATED DOOR LOCK FOR A MOTOR VEHICLE DOOR

BACKGROUND OF THE INVENTION

1. Field of the Invention

The present invention relates to a door hinge assembly for a motor vehicle door including a door hinge having two hinge halves attachable, respectively, to the motor vehicle door and a respective motor vehicle door pillar, and a hinge pin for connecting the first and second hinge halves and supported in one of the two hinge halves with a running fit and removably secured in another of the two hinge halves without a possibility of rotation with respect to the another of the hinge halves, and a door lock formed integrally with the door hinge and including a locking element having at least one detent point and at least one brake and locking member cooperating with the locking element.

2. Description of the Prior Art

There exist many variations of door hinge assemblies consisting of a door hinge and a door lock formed integrally with each other. In most cases, the door lock is mounted on an axial extension of the hinge pin and works together with one of the two hinge halves. However, limited by their construction, the conventional door locks, which are formed integrally with a door hinge, either cannot be used with demountable door hinges at all or, because of the particular construction of a demountable door hinge, when formed integrally with such a door hinge, the door hinge assembly with the integrated door lock require an increased space in the vehicle body. Besides, the known door hinge assemblies consisting of a demountable door hinge and a door lock formed integrally with each other are rather expensive. In particular, the door hinge assemblies consisting of a demountable door hinge and a door lock formed integrally with the door hinge are characterized in that the loading of the brake and locking member is effected with a torsional spring. And that is one of the reasons why such door hinge assemblies occupy an increased space in the motor vehicle body. There were also proposed door locks for demountable door hinges, the locking and retaining action of which is based on the use of a hinge pin having a non-circular cross-section, on one hand, and a non-circular cross-section of the gudgeon bore of a hinge half, on the other hand. Such door lock require very little mounting space, however, they are characterized by very high manufacturing costs. Besides, their use is accompanied by a certain uncertainty with regard to how long they can retain the door in its given hold-over position.

Accordingly, an object of the present invention is a door lock for a motor vehicle door, which can be formed integrally with a demountable door hinge and which would require as little mounting space inside of the vehicle body as possible, while being produced with reduced manufacturing costs.

Another object of the present invention is a door lock, which can be formed integrally with a demountable door hinge and which is characterized by its operational reliability.

Yet another object of the present invention is a door lock, which can be formed integrally with a demountable door hinge and which would not affect the simplicity of the door hinge mounting and dismounting.

A further object of the invention is a door lock, which can be formed integrally with a door hinge and which is characterized by as noiseless operation as possible.

A still further object of the present invention is a door lock, which can be formed integrally with a door hinge and which is suitable for use with heavy motor vehicle doors.

SUMMARY OF THE INVENTION

These and other objects of the present invention, which will become apparent hereinafter, are achieved by mounting the brake and locking member, which is connected with the hinge pin, radially outwardly with respect to the hinge pin. The connection of one or more brake and locking members with the hinge pin insures, independently of the pin shape, a construction of a door hinge-door lock unit which would require a reduced mounting space. In addition, the connection of the brake and locking member or members with the hinge pin results in a very cost-effective production of the door hinge-door lock unit. Furthermore, such a door hinge-door lock unit is characterized by a low-noise operation because it requires a reduced number of components, so that the number of unfavorable tolerance pairs, which are sources of a noise, are reduced to a minimum.

According to the first embodiment of the present invention, it is contemplated to form the locking element as a circular track concentric with respect to a hinge pin axis and which is secured to the one of the two hinge halves without a possibility of rotation relative to the respective hinge half. The brake and locking member is formed as a roll body. The door lock further includes an axle for rotatably supporting the brake and locking member and extending transverse to a hinge pin axis.

According to the first embodiment, it is further contemplated to provide a ring-shaped carrier for receiving the brake and locking member and connected with the hinge pin for joint rotation therewith. In this embodiment, the track is formed by an end surface of a collar provided on the one of the two hinge half. The door hinge assembly according to this embodiment includes a spring for axially displacing the carrier, whereby necessary braking and locking forces are applied to the hinge for retaining the door in an open position. Instead of the collar, which is formed integrally with the respective hinge half, it is contemplated to provide the track on a locking disc connectable to the respective hinge half by at least one but, preferably, three followed drivers.

According to a second, advantageous embodiment of the present invention, it is contemplated to provide a plurality of pairs of brake and locking members arranged opposite each other, and to provide in the track, which forms the locking member, a plurality of indentations defining the detent points and the number of which defines the number of opening positions of a vehicle door and exceeds the number of the brake and locking element, with the indentations likewise being arranged opposite each other in pairs.

In order to insure as noiseless operation of the door lock as possible and a smooth application of a braking and locking force, it is further contemplated, according to the advantageous embodiment of the present invention, to apply to the brake and locking member or members a biasing force in a direction transverse to the rotational axis (axes) of the brake and locking member(s), with the carrier of the brake and locking member(s) being mounted on the hinge pin with a possibility of axial displacement. The biasing force is applied by a spring supported at its opposite end against an axial component provided at the free end of the hinge pin and against the carrier. The spring advantageously is formed by a stack of spring washers which, on one hand, permits to reduce the mounting space required for the door lock and, on the other hand, provides for application of an increased brake and locking force.

According to a further advantageous embodiment of the present invention, the brake and locking member or members is/are formed as a conical roller(s),and the locking element-forming track, which is formed by an end surface of a locking disc, has guide surface(s) for the brake and locking member(s) which is (are) inclined toward the circumference of the locking disc. This measure permits to eliminate surface pressure, which may cause damage of the door lock component and an excessive wear and which may adversely affect the operation of the door lock.

It is further advantageously contemplated to provide in the brake and locking member carrier recesses for receiving the brake and locking members which are formed as roll bodies, and to form the hinge pin component, against which the carrier-biasing spring is supported, as a nut which is screwed onto a threaded free end of the hinge pin.

It is also contemplated, independent of the embodiment form of the door lock, to define the detent points of the track, which forms the locking element, by axial extend track elevations. This formation of the detent points does not depend on whether the track is formed on a collar provided on the hinge pin or by an end surface of a locking disc.

According to a further development of the present invention, it is contemplated to provide in the brake and locking member carrier loading springs associated with the brake and locking members which are formed as roller bodies.

It is further contemplated to form the carrier, which is connected with the hinge pin for joint rotation therewith, as a plate spring, with the brake and locking members being formed as sliding bodies, advantageously as plastic gliders.

According to a still further embodiment of the present invention, it is contemplated to form the door lock of three components or parts, with the door lock including, located opposite each other, a track with detent points for the brake and locking members and which is fixedly connected with the hinge pin for joint rotation therewith, and a spring-biased, in axial direction, abutment track. The track, which is provided with the detent point, can be formed by a locking disc or a plate spring, while the abutment track can be formed by an abutment disc.

According to the present invention, the brake and locking member carrier can be provided, independent of with which embodiment of a door hinge assembly according to the present invention the carrier is used, with a recess cooperating with a respective circumferential cross-sectional profile of the hinge pin, which cross-sectional profile deviates from a regular circle, for connecting the carrier with the hinge pin for joint rotation therewith.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1:
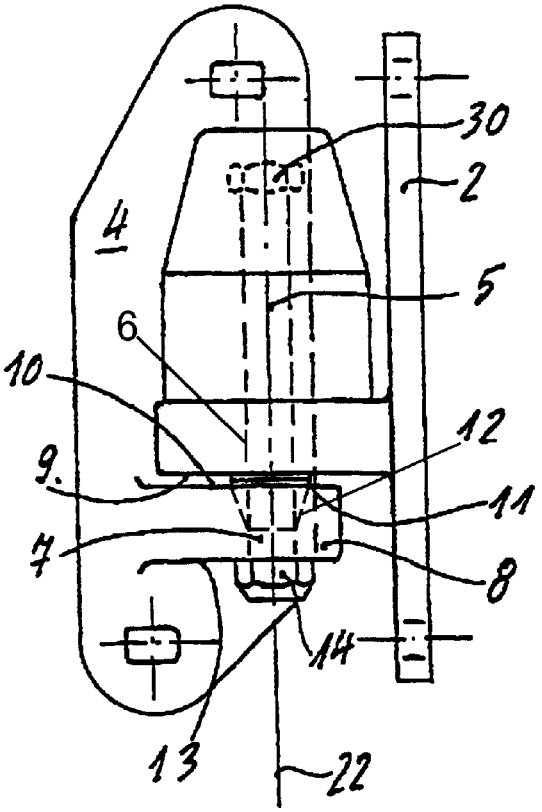
FIG. 1 is a side view of a demountable door hinge for a motor vehicle door according to the present invention which is formed integrally with a door lock.
Figure 2:
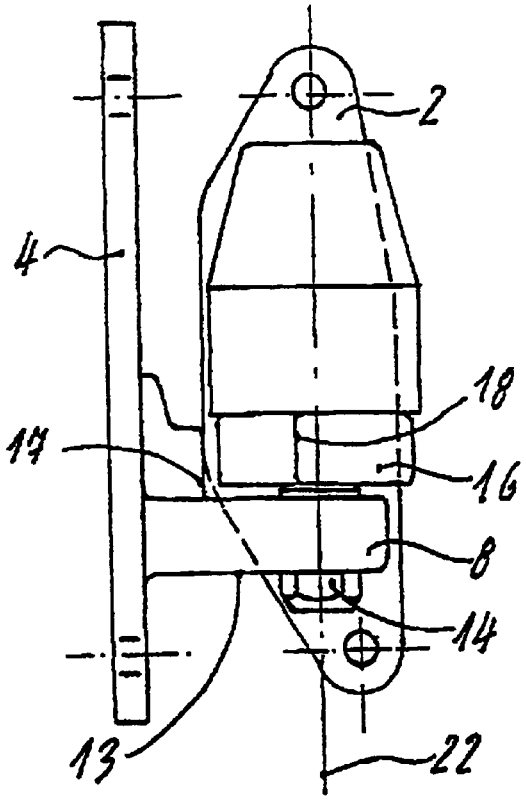
FIG. 2 is a front view of the door hinge shown in FIG. 1.
Figure 3:
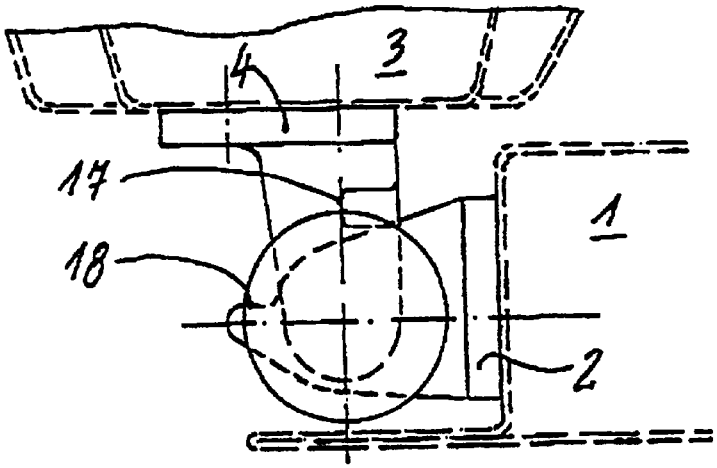
FIG. 3 is a plan view of the door hinge shown in FIGS. 1 and 2.

A demountable door hinge for a motor vehicle door according to the present invention, which is shown in the drawings, is formed of a first hinge half 2 attachable to a door component which forms part of a motor vehicle door 1 shown schematically in FIG. 3, a second hinge half 4 attachable to a door pillar 3 likewise shown schematically, and a hinge pin 5 which pivotally connects the hinge halves 2 and 4 with each other. The hinge pin 5 is supported in the hinge half 2 by a bearing sleeve 6 formed of a maintenance-free bearing material. The hinge pin 5 is supported in the bearing sleeve 6 with a running fit which insures a free rotation of the hinge pin 5, but it is retained from axial displacement in the hinge half 2. In a mounting position of the door hinge, the hinge pin 5 is secured in the gudgeon 8 of the hinge half 4 against rotation relative to the hinge half 4 with radially extending form-lockingly operating means 7. The hinge pin 5 has a radially extending collar 11 which engages adjacent surfaces 9 and 10 of the hinge halves 2 and 4. The collar 11 has, at a side hereof adjacent to the hinge half 4, a cone 12 tapering toward the end of the hinge pin 5. The gudgeon bore of the hinge half 4 has a conical surface corresponding to the cone 12 of the collar 11. The hinge pin 5 is secured against automatic lifting from the gudgeon bore of the hinge half 4 by a nut 14 which engages the outer surface 13 of the gudgeon 8 of the hinge half 4 and cooperates with a tread provided at the free laver end of the hinge pin 5. The limit stop limiting the operating of the door is formed by cooperating with each other stops 17 and 18 provided on gudgeons 8 and 16 of the two hinge halves 2 and 4, respectively.

The door lock, which is formed integrally with the door hinge is provided on the hinge half 4. In the embodiment shown in the drawings, the door lock includes a locking element 20, a plurality of brake and locking members 21, a carrier 25 for the brake and locking members 21, and spring means 29 for biasing the carrier 25 in the axial direction. The locking element 20 is formed as a ring-shaped track 20 which is concentric with respect to the axis of the hinge pin 5 and is provided with detent points 19. The track 20 is secured to the element of the hinge half 2 in which the hinge pin 5 is secured with a running fit. The plurality of brake and locking members 21 cooperate with the track 20. The brake and locking members 21 are rotatably supported on respective axles 23 which extend transverse to the axis 22 of the hinge pin 5.

The brake and locking members 21 are arranged in the carrier 25 for rotation about the axles 23. The carrier 25 has a central bore 24, through which the hinge pin 5 extends, and is fixedly secured to the hinge half 4. The brake and locking members 21, which are formed as roll bodies, are located in grooves 26 of the carrier 25.

The track 20 is formed by an end surface of a collar 28 of a locking disc 27 which is arranged concentrically with respect to the hinge pin axis 22 and is fixedly secured on the hinge half by a follower driver 33. The guide surfaces of the track 20 are inclined toward the outer circumference of the locking disc 27. The brake and locking members 21 are formed as conical rolls the outer surfaces of which are complementary to the guide surfaces of the track 20.

Figure 4:
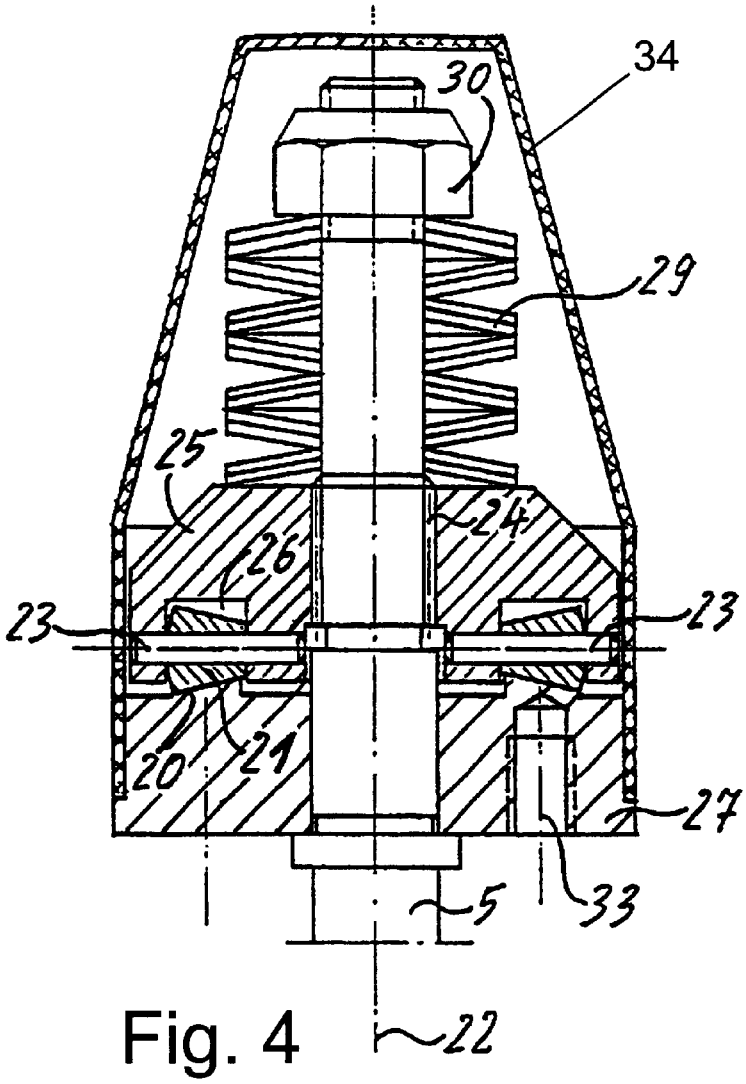
FIG. 4 is a cross-sectional view of a door hinge according to the present invention.
Figure 6:
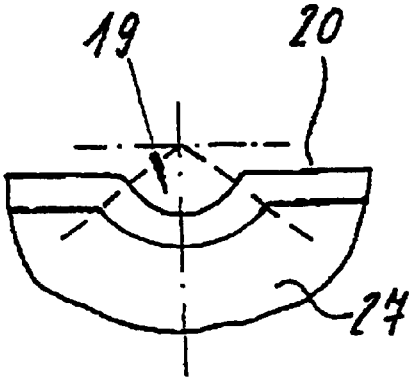
FIG. 6 is a side view of a detail of the door lock shown in FIG. 4.
Figure 7:
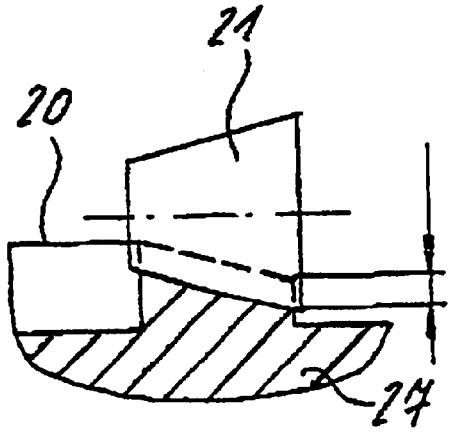
FIG. 7 is a cross-sectional view of the detail of FIG. 6.
Figure 5:
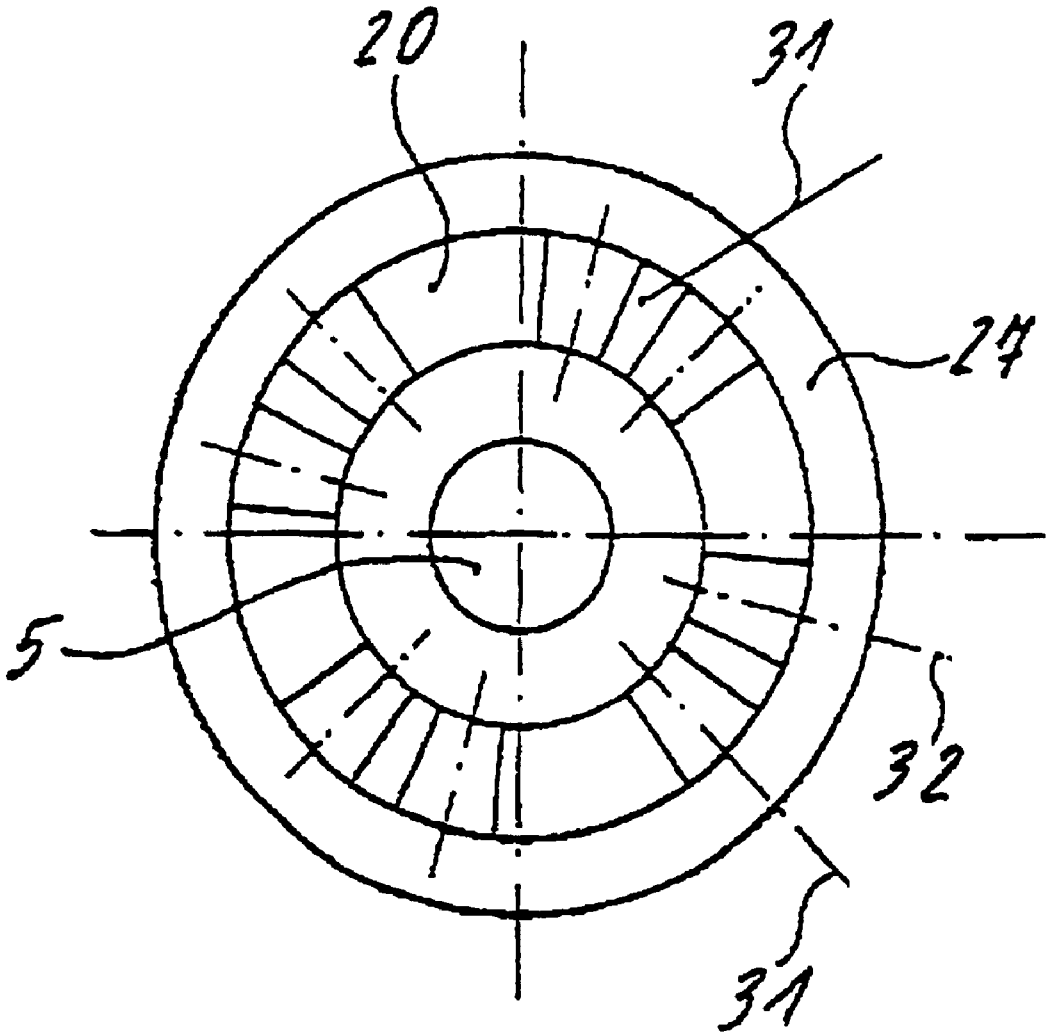
FIG. 5 is a schematic view showing the location of brake and detent points of the door lock shown in FIG. 4.

For applying the necessary track and locking forces, the carrier 25 is secured for rotation with the hinge pin 5 and for axial displacement relative thereto. The spring means 29 is formed by a stack of spring washers supported at opposite ends thereof against a nut 30 mounted on the free end of the hinge pin 5, and an upper surface of the carrier 25. As shown in FIGS. 4 and 5 in particular, the brake and locking members 21 are arranged in pairs opposite each other with respect to the hinge pin axis 22. The number of locked opening positions of the door is determined by a number of paired detent points 19, which are defined by preliminary 31 and locking 32 detents formed by indentations in the track 20. The locking element 20 is protected against dust and dirt with a protected bonnet 34 secured at the circumference of the locking disc 27.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A door hinge assembly for a motor vehicle door, comprising:

a door hinge having first and second hinge halves attachable, respectively, to the motor vehicle door and a respective motor vehicle door pillar, and a hinge pin for connecting the first and second hinge halves and supported in one of the first and second hinge halves with a running fit and removably secured in another of the first and second halves without a possibility of rotation with respect to the another of the first and second halves; and a door lock formed integrally with the door hinge, said door lock comprising:

a locking element, said locking element having at least one detent point, said locking element being formed as a circular track concentric with respect to a hinge pin axis, and said locking element being secured to the one of the first and second hinge halves without a possibility of rotation relative to the one of the first and second hinge halves, a ring-shaped carrier, said carrier being connected with said hinge pin for joint rotation therewith, and at least one brake and locking member, said brake and locking member being received in said ring-shaped carrier, said brake and locking member thereby being connected with and being arranged radially outwardly of said hinge pin, and said brake and locking member being formed as a roll body, an axle, said axle rotatably supporting said brake and locking member in said carrier and said axle extending transversely to the hinge pin axis, wherein said brake and locking member cooperate with said locking element for locking the door in a predetermined opening position of the door by axially displacing said carrier, and wherein said opening position is determined by said detent point.

2. A door hinge assembly as set forth in claim 1, further comprising spring means for axially displacing the carrier.

3. A door hinge assembly as set forth in claim 1, wherein the door lock comprises at least one pair of brake and locking members arranged opposite each other.

4. A door hinge assembly as set forth in claim 3, wherein the track comprises paired opposite indentations formed therein and defining detent points, the indentations exceeding in number a number of the brake and locking members.

5. A door hinge assembly as set forth in claim 4, further comprising spring means for applying a biasing force to the brake and locking members in a direction transverse to rotational axis of the brake and locking members.

6. A door hinge assembly as set forth in claim 1, wherein the carrier is supported on the hinge pin for axial displacement there along, and wherein the door hinge assembly further comprises spring means supported against a hinge pin component provided on an axial extension of the hinge pin for axially displacing the carrier.

7. A door hinge assembly as set forth in claim 6, wherein the spring means comprises a stack of spring washers.

8. A door hinge assembly as set forth in claim 7, wherein the hinge pin component is formed by a nut screwed on a free end of the hinge pin.

9. A door hinge assembly as set forth in claim 1, wherein the roll body is formed as a conical roller, and wherein the locking element is formed as a locking disc defining a track having a guide surface for the conical roller, the guide surface being inclined toward a circumference of the locking disc.

10. A door hinge assembly as set forth in claim 1, wherein the carrier has groove means for receiving the at least one brake and locking member.

11. A door hinge assembly as set forth in claim 1, wherein the track is formed on a locking disc, and wherein the hinge assembly further comprises at least one follower driver for securing the locking disc to the one of the first and second hinge halves.

12. A door hinge assembly as set forth in claim 1, further comprising a stop for limiting an extent of door opening and formed by cooperating stops formed on the first and second hinge halves.

13. A door hinge assembly as set forth in claim 1, further comprising a protective bonnet for protecting the locking element.

* * * * *